US007204098B2

(12) United States Patent
Yamada et al.

(10) Patent No.: US 7,204,098 B2
(45) Date of Patent: Apr. 17, 2007

(54) OIL SEPARATION STRUCTURE FOR REFRIGERANT COMPRESSOR

(75) Inventors: Yoshinari Yamada, Kariya (JP); Suguru Hirota, Kariya (JP); Hajime Kurita, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 377 days.

(21) Appl. No.: 10/834,740

(22) Filed: Apr. 28, 2004

(65) Prior Publication Data

US 2004/0221610 A1 Nov. 11, 2004

(30) Foreign Application Priority Data

May 8, 2003 (JP) ..... P2003-130749

(51) Int. Cl.
*F25B 43/02* (2006.01)
*F04B 1/26* (2006.01)

(52) U.S. Cl. ..... 62/470; 62/469; 62/473; 417/222.2

(58) Field of Classification Search ..... 62/469, 62/470, 473; 417/222.2
See application file for complete search history.

(56) References Cited

U.S. PATENT DOCUMENTS

| | | | | |
|---|---|---|---|---|
| 4,392,788 | A | 7/1983 | Nakamura et al. | 417/269 |
| 5,159,820 | A * | 11/1992 | Ohishi et al. | 62/468 |
| 5,234,785 | A * | 8/1993 | Itami et al. | 430/59.4 |
| 5,499,515 | A * | 3/1996 | Kawamura et al. | 62/470 |
| 5,580,224 | A * | 12/1996 | Ikeda et al. | 417/269 |
| 5,636,974 | A | 6/1997 | Ikeda et al. | 417/269 |
| 5,795,139 | A * | 8/1998 | Ikeda et al. | 417/269 |
| 5,823,294 | A | 10/1998 | Mizutani et al. | 184/63 |
| 6,015,269 | A * | 1/2000 | Ota et al. | 417/222.2 |
| 6,134,898 | A * | 10/2000 | Umemura et al. | 62/193 |
| 6,149,397 | A * | 11/2000 | Mizutani et al. | 417/222.2 |
| 6,149,398 | A * | 11/2000 | Fukanuma et al. | 417/222.2 |
| 6,179,578 | B1 * | 1/2001 | Kayukawa et al. | 417/313 |
| 6,237,362 | B1 * | 5/2001 | Jang | 62/469 |
| 6,481,240 | B2 * | 11/2002 | Strikis et al. | 62/470 |
| 6,497,114 | B1 | 12/2002 | Strikis et al. | 62/473 |
| 6,511,297 | B2 * | 1/2003 | Ota et al. | 417/222.2 |
| 6,558,133 | B2 * | 5/2003 | Fukanuma et al. | 417/222.2 |
| 2002/0110291 | A1 * | 8/2002 | Edwards et al. | 383/104 |
| 2002/0134101 | A1 * | 9/2002 | Gennami et al. | 62/469 |

FOREIGN PATENT DOCUMENTS

| | | |
|---|---|---|
| DE | 101 56 785 | 6/2002 |
| EP | 0 406 866 | 1/1991 |
| EP | 0 926 346 | 6/1999 |

(Continued)

*Primary Examiner*—Cheryl Tyler
*Assistant Examiner*—B. Clayton McCraw
(74) *Attorney, Agent, or Firm*—Morgan & Finnegan L.L.P.

(57) ABSTRACT

The present invention relates to a structure for separating oil from a refrigerant gas containing the oil. The refrigerant gas is discharged from a refrigerant compressor which forms a part of refrigerating cycle to an external refrigerant circuit. The oil separation structure includes a separation chamber in which the oil is separated from the discharge refrigerant gas having a cylindrical inner surface, and a plurality of introduction passages through which the discharge refrigerant gas is introduced into the separation chamber. The oil is separated by centrifugal action from the discharge refrigerant gas by turning the discharge refrigerant gas introduced into the separation chamber along the cylindrical inner surface.

10 Claims, 3 Drawing Sheets

FOREIGN PATENT DOCUMENTS

| | | |
|---|---|---|
| EP | 0 965 804 | 12/1999 |
| EP | 1 167 762 | 1/2002 |
| JP | 08-035485 | 2/1996 |
| JP | 10-141229 | 5/1998 |
| JP | 10-281060 | 10/1998 |
| JP | 11-324910 | 11/1999 |
| JP | 2001-165049 | 6/2001 |
| JP | 2001-289164 | 10/2001 |
| JP | 2002-031050 | 1/2002 |

* cited by examiner

OIL SEPARATION STRUCTURE FOR REFRIGERANT COMPRESSOR

BACKGROUND OF THE INVENTION

The present invention relates to a structure for separating oil, or refrigeration oil, from the refrigerant gas discharged into a discharge chamber of a refrigerant compressor which forms a part of refrigerating cycle of a vehicle air conditioning apparatus.

This type of oil separating structure is disclosed by Japanese Unexamined Patent Publication No. 10-281060. As disclosed specifically on pages 6 to 9 of the reference and FIGS. 1 and 2 thereof, the oil separation structure separates by centrifugal action oil from the discharge refrigerant gas containing therein such oil by introducing the discharge refrigerant gas through an introduction passage into a separation chamber having a cylindrical inner surface and then turning the discharge refrigerant gas in the separation chamber along the cylindrical inner surface. By so separating the oil from the refrigerant gas, the amount of oil which flows out from the refrigerant compressor to an external refrigerant circuit is reduced, and therefore, deterioration of the heat exchanger efficiency which is caused by adhesion of oil to heat exchanger such as a gas cooler and an evaporator in the external refrigerant circuit is prevented.

However, when the introduction passage is formed with a small cross-sectional area, the introduction passage serves as a throttle regulating the flow, thereby increasing the pressure loss of the discharge refrigerant gas, with the result that the performance of the refrigerant compressor is decreased. When the cross sectional area of the introduction passage is set relatively large, on the other hand, the streamline of the discharge refrigerant gas flowing from the introduction passage into the separation chamber is disordered, and the relatively large-sized opening of the introduction passage in the cylindrical inner surface prevents the discharge refrigerant gas from turning in the separation chamber, thus inviting a reduced oil separating capacity. That is, in the prior art structure of the above reference, it has been difficult to satisfy both the maintenance of the desired operating capacity of the refrigerant compressor and the successful oil separation.

SUMMARY OF THE INVENTION

The present invention is directed to an oil separation structure for a refrigerant compressor which satisfies both the maintenance of the desired operating capacity of the refrigerant compressor and the successful oil separation.

The present invention provides a structure for separating oil from a refrigerant gas containing the oil. The refrigerant gas is discharged from a refrigerant compressor which forms a part of refrigerating cycle to an external refrigerant circuit. The oil separation structure includes a separation chamber in which the oil is separated from the discharge refrigerant gas having a cylindrical inner surface, and a plurality of introduction passages through which the discharge refrigerant gas is introduced into the separation chamber. The oil is separated by centrifugal action from the discharge refrigerant gas by turning the discharge refrigerant gas introduced into the separation chamber along the cylindrical inner surface.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
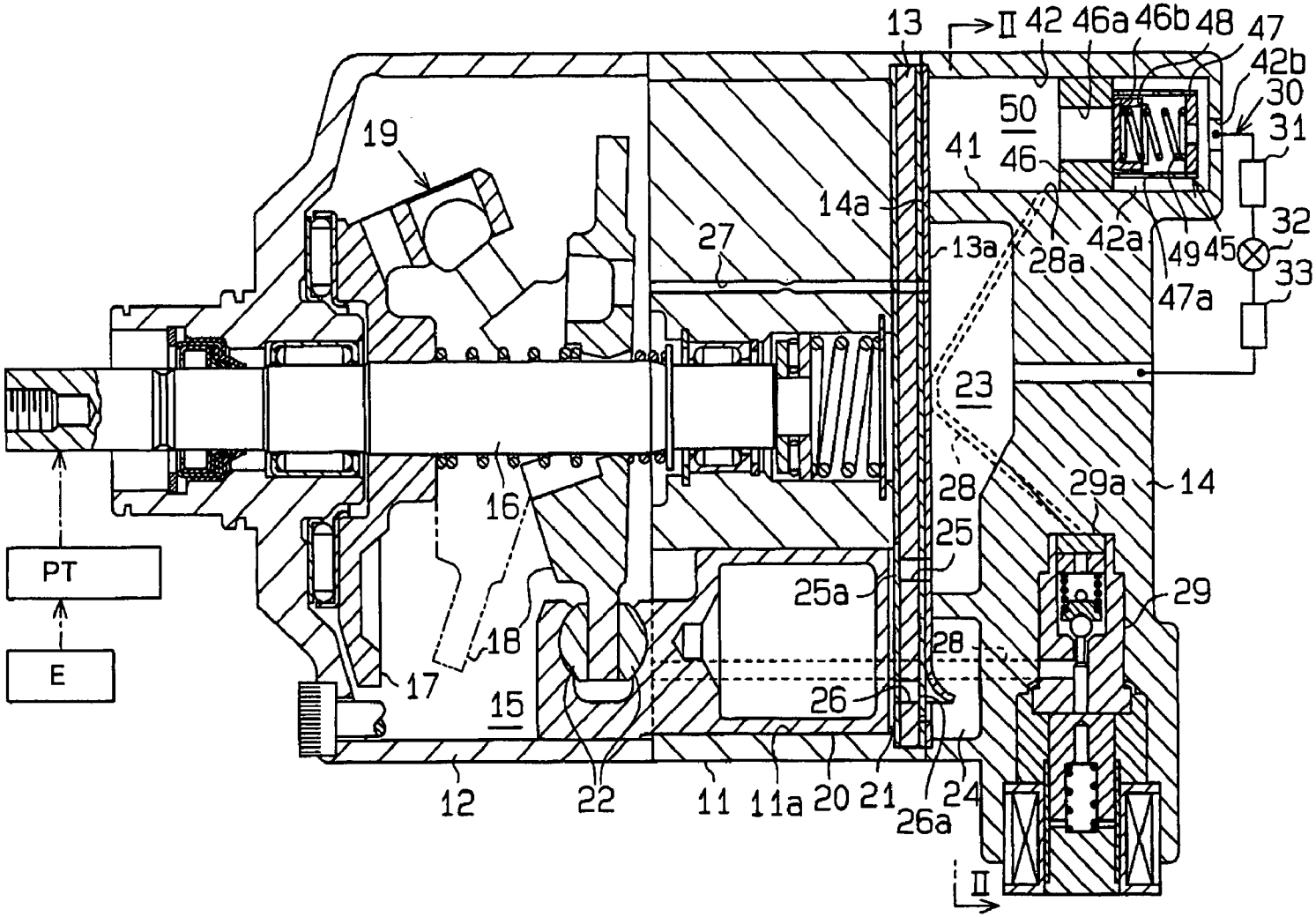
FIG. 1 is a longitudinal sectional view illustrating a variable displacement refrigerant compressor of swash plate type according to a preferred embodiment of the present invention.

An oil separation structure according to a preferred embodiment of the present invention will be now described with reference to FIGS. 1 through 3. The present preferred embodiment is applied to a variable displacement refrigerant compressor of swash plate type for use in a refrigerant circulation circuit of a vehicle air conditioning apparatus, or in a refrigerating cycle of a vehicle air conditioning apparatus. In FIG. 1, the left side of the compressor is the front and the right side thereof is the rear.

First of all, the refrigerant compressor will be now described. The refrigerant compressor is referred to merely as a compressor hereinafter. As shown in FIG. 1, the compressor has a compressor housing which includes a cylinder block 11, a front housing 12 which is fixedly joined to the front end of the cylinder block 11, and a rear housing 14 which is fixedly joined to the rear end of the cylinder block 11 through a valve plate assembly 13. The rear housing 14 serves as a cylinder head. The cylinder block 11 and the front housing 12 define a crank chamber 15 through which a drive shaft 16 extends.

The drive shaft 16 is operatively connected to a vehicle engine E through power transmission mechanism PT, thus the drive shaft 16 being rotated by the engine E. In the present preferred embodiment, the power transmission mechanism PT is of a clutchless type such as combination of belt and pulley. That is, the drive shaft 16 is constantly connected to the engine E.

In the crank chamber 15, a lug plate 17 is fixedly mounted on the drive shaft 16 for rotation therewith. In the crank chamber 15, a swash plate 18 is supported by the drive shaft 16 so as to slide over the drive shaft 16 and incline relative to the axis of the drive shaft 16. A hinge mechanism 19 is interposed between the lug plate 17 and the swash plate 18, such that the swash plate 18 is operatively connected with the lug plate 17 through the hinge mechanism 19 and, therefore, rotates synchronously with the lug plate 17 and the drive shaft 16. In addition, the provision of the hinge mechanism 19 between the lug plate 17 and the swash plate 18 permits the swash plate 18 to incline with respect to the axis of the drive shaft 16 while sliding along the drive shaft 16.

Figure 2:
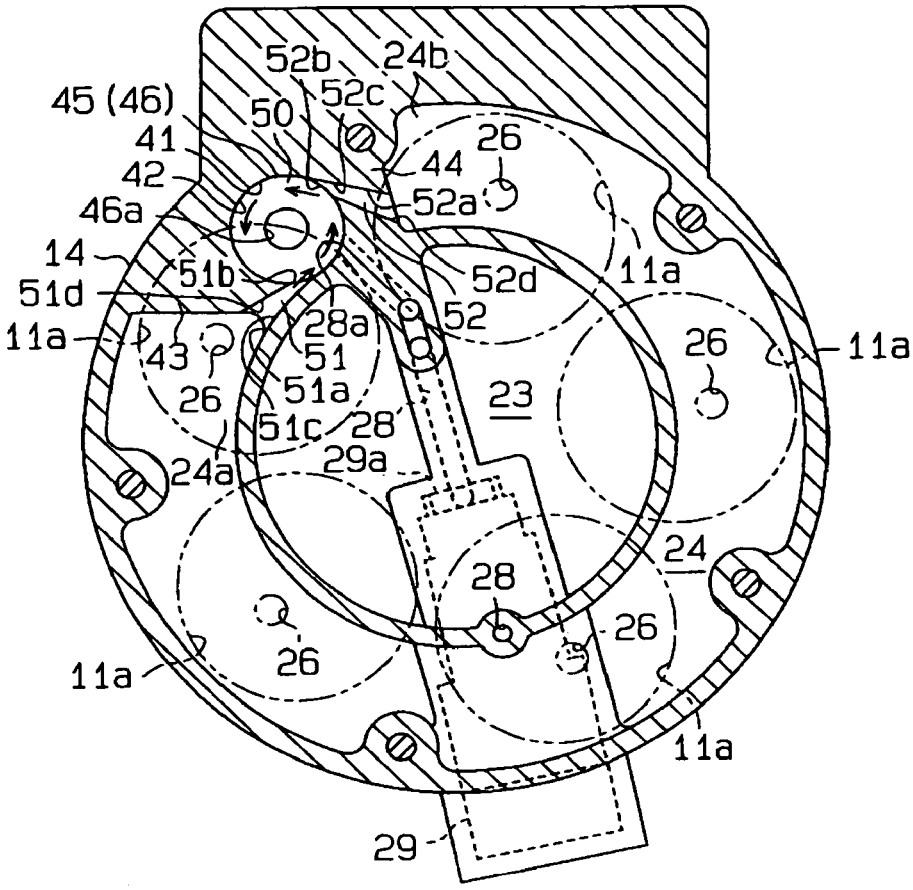
FIG. 2 is a cross sectional view as seen from the line II—II in FIG. 1.

Referring to FIGS. 1 and 2, a plurality of cylinder bores 11*a* is formed through the cylinder block 11 in parallel to and surrounding the drive shaft 16. (only one cylinder bore 11*a* being shown in FIG. 1). In FIG. 2, the cylinder bores 11*a* in the rear housing 14 are shown by alternative long and two short dashes line. A single-head piston 20 is received in each cylinder bore 11*a* for reciprocating movement.

The openings on the front and rear sides of the cylinder bores 11*a* are closed by the pistons 20 and the valve plate assembly 13, respectively. A compression chamber 21 is defined in each cylinder bore 11*a*, whose volume is varied in accordance with the reciprocating motion of the piston 20. Each piston 20 is engaged with the outer periphery of the swash plate 18 through a pair of shoes 22. Therefore, the rotating movement of the swash plate 18 with the rotation of the drive shaft 16 is converted into the reciprocating movement of each piston 20 by way of the shoes 22.

The rear housing 14 has formed in the central region thereof a suction chamber 23 and in the region surrounding the suction chamber 23 a discharge chamber 24 which is C-shaped as seen in the transverse section. In other words, the discharge chamber 24 is formed in an annular shape, but part of which is disconnected so as to describe a letter "C", as clearly shown in FIG. 2. As the piston 20 moves from the top dead center toward the bottom dead center, refrigerant gas in the suction chamber 23 is drawn into the compression chamber 21 through a suction port 25 formed in the valve plate assembly 13 while pushing open a suction valve 25*a* formed in the valve plate assembly 13. The refrigerant gas thus drawn into the compression chamber 21 is then compressed to a predetermined pressure level as the piston 20 moves from the bottom dead center toward the top dead center. Subsequently, the compressed refrigerant gas is discharged into the discharge chamber 24 through a discharge port 26 formed in the valve plate assembly 13 while pushing open a discharge valve 26*a* formed in the valve plate assembly 13.

In the compressor housing, a bleed passage 27 and a supply passage 28 are formed and a control valve 29 is arranged. The bleed passage 27 is formed so as to allow part of refrigerant gas in the crank chamber 15 to flow to the suction chamber 23, while the supply passage 28 is formed so as to allow part of refrigerant gas in the discharge chamber 24 to flow into crank chamber 15. In the present preferred embodiment, an electromagnetic valve as a control valve 29 is disposed in the supply passage 28.

Externally adjusting the opening of the control valve 29 depending on cooling load, the amount of high pressure refrigerant gas flowing through the supply passage 28 into the crank chamber 15 and the amount of refrigerant gas flowing out from the crank chamber 15 through the bleed passage 27 is controlled in relation to each other and, therefore, the pressure in the crank chamber 15 is determined. The pressure differential between the pressure in the crank chamber 15 and the pressure in the compression chamber 21 both of which are applied to the piston 20 is varied in accordance with variation of the pressure in the crank chamber 15, thus varying angle of inclination of the swash plate 18. Therefore, the stroke of the pistons 20, or displacement of the compressor, is adjusted.

Specifically, as the opening of the control valve 29 is reduced and the pressure in the crank chamber 15 is also reduced, the angle of inclination of the swash plate 18, and hence stroke of the piston 20 is increased. Thus, the displacement of the compressor is increased. The swash plate 18 in its maximum angle of inclination is shown by alternative long and two short dashes line. As the opening of the control valve 29 is increased and the pressure in the crank chamber 15 is also increased, the angle of inclination of the swash plate 18 is reduced and the stroke of the piston 20 is reduced, accordingly. Thus, the displacement of the compressor is reduced. In FIG. 1, the swash plate 18 shown by solid lines is placed in the position for its minimum angle of inclination.

As shown schematically in FIG. 1, the refrigerant cycle is formed by the aforementioned compressor and an external refrigerant circuit 30 which includes a gas cooler 31, an expansion valve 32 and an evaporator 33.

The following will now describe a check valve and an oil separation structure that are incorporated in the compressor will be described. As shown in FIGS. 1 through 3, a separation chamber forming hole 42 having a cylindrical inner surface 41 is formed in a joint surface 14*a* of the rear housing 14 adjacent to the rear surface of the valve plate assembly 13. The separation chamber forming hole 42 is formed in such an orientation that its axis extends in parallel to that of the drive shaft 16. Additionally, the separation chamber forming hole 42 is located at a position In the rear housing 14 between the two ends of C-shaped discharge chamber 24, namely the first end 24*a* of the discharge chamber 24 on the left side and the second end 24*b* thereof on the right side as seen in the transverse section of FIG. 2, respectively.

In the rear housing 14, the separation chamber forming hole 42 is separated from the discharge chamber 24 by a first wall 43 at the first end 24*a* and by a second wall 44 at the second end 24*b*. The separation chamber forming hole 42 is arranged such that its inner space forms a part of refrigerant passage between the discharge chamber 24 and the gas cooler 31 in the external refrigerant circuit 30. For this purpose, an outlet 42*b* is formed through the bottom surface of the separation chamber forming hole 42 for making fluid communication between the inner space of the separation chamber forming hole 42 and the external refrigerant circuit 30.

A check valve 45 is accommodated in the separation chamber forming hole 42 at a position adjacent to the outlet 42*b* as shown in FIG. 1. The check valve 45 prevents the refrigerant gas from flowing back from the external refrigerant circuit 30 to the discharge chamber 24. The check valve 45 includes a valve body 48, a spring 49 urging the valve body 48 in its closing direction, a case 47 receiving therein the spring 49 and the valve body 48 and having a communication hole 47*a* forming a part of refrigerant passage, and a cylindrical seat 46 to which the case 47 is fixed. Thus, the seat 46 cooperates with the case 47 to movably support the valve body 48.

The check valve 45 is installed in the separation chamber forming hole 42 by press-fitting the seat 46 in the separation chamber forming hole 42. The seat 46 serves as a partition member separating the separation chamber forming hole 42 into a separation chamber 50 on the open side of the separation chamber forming hole 42, or the side adjacent to the valve plate assembly 13, and a chamber 42*a* in which the check valve 45 is accommodated. The separation chamber 50 is defined between the seat 46 of the check valve 45 and the valve plate assembly 13 with the open end of the separation chamber forming hole 42 closed by the valve plate assembly 13 interposed in place between the cylinder block 11 and the rear housing 14. A valve port 46*a* is formed axially through the central portion of the seat 46 between the check valve accommodation chamber 42*a* and the separation chamber 50. The valve port 46*a* is closed when the valve body 48 is in contact with a valve seat 46*b* of the seat 46, so that the communication between the separation chamber 50 and the check valve accommodation chamber 42*a* is shut off. The valve port 46*a* is opened when the valve body 48 is moved away from the valve seat 46*b* for fluid communication between the separation chamber 50 and the check valve accommodation chamber 42*a*.

That is, when the pressure of discharged refrigerant gas (discharge pressure) is sufficiently high, the valve body 48 is moved by such pressure while overcoming the force of the spring 49 thereby to open the valve port 46*a*, thus the check valve 45 allowing the refrigerant to circulate through the external refrigerant circuit 30. When the compressor displacement is minimum and, therefore, the discharge pressure is low, on the other hand, the valve body 48 is urged by the spring 49 to close the valve port 46*a*, so that the check valve 45 prevents the circulation of the refrigerant by way of the external refrigerant circuit 30. Thus, in the present preferred embodiment in which the clutchless type power transmission mechanism PT is used, the check valve 45 doubles to open and close the refrigerant circulation circuit in accordance with the displacement of the compressor.

Figure 3:
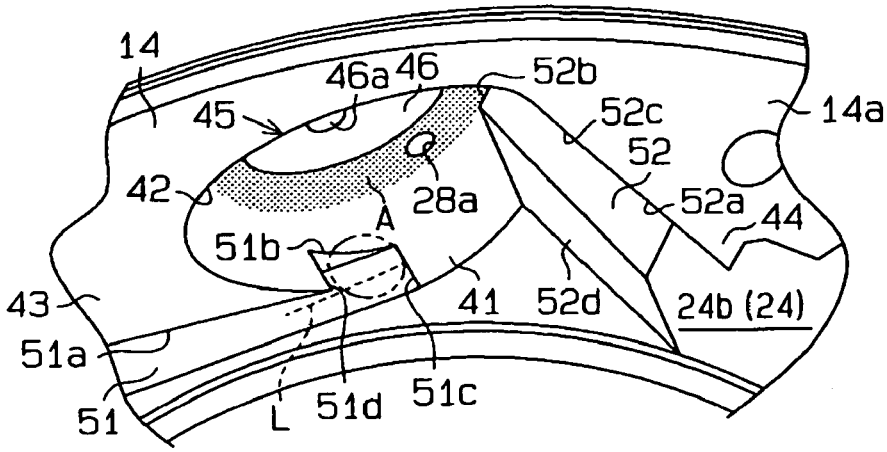
FIG. 3 is a partial perspective view illustrating an oil separation chamber of a rear housing.

As shown in FIGS. 2 and 3, the discharge chamber 24 and the separation chamber 50 are in communication via a first introduction passage 51 and a second introduction passage 52. The first and second introduction passages 51 and 52 are formed through the first and second walls 43 and 44 of the rear housing 14, respectively. The first and second introduction passages 51 and 52 are formed in such an orientation that the refrigerant gas introduced from the discharge chamber 24 into the separation chamber 50 through these passages 51 and 52 will flow turning in the same direction (or counterclockwise direction as indicated by arrows in FIG. 2) within the separation chamber 50.

To be more specific, the first introduction passage 51 has an opening 51*b* thereof formed at a lower part of the separation chamber 50, and the discharge refrigerant gas which is flowed to the first end 24*a* of the discharge chamber 24 is introduced into the separation chamber 50 rightward and upward from the opening 51, as seen in FIG. 2. The second introduction passage 52 has an opening 52*b* thereof formed at an upper right position of the separation chamber 50, and the discharge refrigerant gas flowing to the second end 24*b* of the discharge chamber 24 is introduced into the separation chamber 50 leftward from the opening 52, also as seen in FIG. 2.

The first introduction passage 51 is provided by a first groove 51*a* which is formed through the first wall 43 in the joint surface 14*a* of the rear housing 14 and closed by the joint surface 13*a* of the valve plate assembly 13. Similarly, the second introduction passage 52 is provided by a second groove 52*a* which is formed through the second wall 44 in the joint surface 14*a* of the rear housing 14 and closed by the joint surface 13*a* of the valve plate assembly 13. That is, each of the first and second introduction passages 51, 52 is formed at a joint between the valve plate assembly 13 and the rear housing 14.

The first and second introduction passages 51, 52 are so constructed that the cross sectional areas thereof gradually reduce from the side of the discharge chamber 24 toward the openings 51*b*, 52*b*, respectively. That is, the first and second grooves 51*a*, 52*a* which are formed in the joint surface 14*a* of the rear housing 14 are so constructed that the cross sectional areas thereof gradually reduce from the side of the discharge chamber 24 toward the openings 51*b*, 52*b*, respectively. As shown in FIG. 3, the cross sections of the first and second introduction passages 51, 52 are shaped in a quadrangle.

As shown in FIG. 2, the first introduction passage 51 has a tangent inner wall surface 51*c* which appears as a tangent line to a circle of the cylindrical inner surface 41 as seen in its transverse section and an inner wall surface 51*d* formed in facing relation to the tangent inner wall surface 51*c*. At the opening 51*b* of the first introduction passage 51 in the separation chamber 50, the tangent inner wall surface 51*c* extends further than the facing inner wall surface 51*d* as seen in the direction in which the discharge refrigerant gas turns in the separation chamber 50 (or counterclockwise direction in FIG. 2). The first introduction passage 51 is so constructed that its cross sectional area gradually reduces from the side of the discharge chamber 24 toward the opening 51*b* with a gradually decreasing spaced interval between the tangent and facing wall surfaces 51*c*, 51*d*.

The second introduction passage 52 has a tangent inner wall surface 52*c* which appears as a tangent line to a circle of the cylindrical inner surface 41 as seen in its transverse section and an inner wall surface 52*d* formed in facing relation to the tangent inner wall surface 52*c*. At the opening 52*b* of the second introduction passage 52 in the separation chamber 50, the tangent inner wall surface 52*c* extends further than the facing inner wall surface 52*d* as seen in the direction in which the discharge refrigerant gas turns in the separation chamber 50 (or counterclockwise direction in FIG. 2). The second introduction passage 52 is so constructed that its cross sectional area gradually reduces from the side of the discharge chamber 24 toward the opening 52*b* with a gradually decreasing spaced interval between the tangent and facing wall surfaces 52*c*, 52*d*.

That is, the first and second introduction passages 51 and 52 are both formed such that the streamline of the discharge refrigerant gas introduced to the separation chamber 50 is substantially tangent to the circle of the cylindrical inner surface 41 as viewed in its transverse section.

In the separation chamber 50, the discharge refrigerant gas flows turning along the cylindrical inner surface 41 and, oil contained in the refrigerant gas is separated therefrom under the influence of the centrifugal force. The discharge refrigerant gas from which the oil is removed flows from the separation chamber 50 into the check valve 45 through the opened valve port 46*a*. With the check valve 45 thus opened, the discharge refrigerant gas is supplied to the external refrigerant circuit 30 through the outlet 42*b* of the separation chamber forming hole 42. Providing such oil separation structure, the amount of oil which is brought out from the compressor to the external refrigerant circuit 30 is reduced and, therefore, the deterioration of heat exchanger efficiency which is caused by adhesion of oil to heat exchangers of the external refrigerant circuit 30 such as the gas cooler 31 and the evaporator 33 is prevented successfully.

In the cylindrical inner surface 41 of the separation chamber 50, an opening 28*a* of the supply passage 28 is formed. Therefore, oil in the separation chamber 50 is supplied into the crank chamber 15 together with the discharge refrigerant gas through the supply passage 28 on condition that the control valve 29 is open. Thus, the supply passage 28 which interconnects the separation chamber 50 with the crank chamber 15, whose pressure is lower than of the separation chamber 50, doubles as an oil returning passage.

As shown in FIG. 3, the opening 52*b* of the second introduction passage 52 is formed closer to the seat 46 than the first opening 51*b* of the first introduction passage 51. Area on the cylindrical inner surface 41 lying between the opening 52*b* of the second introduction passage 52 and the seat 46 as seen in the axial direction of the separation chamber forming hole 42 being designated by "A" (or shaded area in FIG. 3), the opening 28*a* of the supply passage 28, which also serves as an opening of the oil returning passage, is located in this area "A".

A filter 29*a* is arranged in the control valve 29 on the side of the separation chamber 50 adjacent to the supply passage 28, so that the oil and the discharged refrigerant gas flowing from the separation chamber 50 into the supply passage 28 are supplied to the control valve 29 and the crank chamber 15 only after foreign matters contained in the oil and refrigerant gas are removed by the filter 29*a*. The oil which is supplied into the crank chamber 15 lubricates sliding surfaces in the compressor such as surfaces between the pistons 20 and the shoes 22, and between the shoes 22 and the swash plate 18.

The aforementioned embodiment performs the following features.

(1) The oil separation structure, which includes a plurality of introduction passages 51, 52 through which the discharge refrigerant gas is sent from the discharge chamber 24 to the separation chamber 50, makes it possible to set the cross sectional area of each of the first and second introduction passages 51, 52 small enough for the discharge refrigerant gas to make the desired turning movement in the separation chamber 50. In addition, the above oil separation structure permits the total cross sectional area of the first and second introduction passages 51, 52 to be large enough for the discharge refrigerant gas to flow smoothly in these passages 51, 52. Thus, successful oil separation is accompanied without reducing the operating performance of the compressor.

(2) The first and second introduction passages 51, 52 of the preferred embodiment of the oil separation structure are in communication with the discharge chamber 24 via the first and second ends 24*a*, 24*b* of the discharge chamber 24, respectively. Therefore, in comparison with a structure in which the discharge chamber communicates with the separation chamber via a passage formed only at one end of the discharge chamber and, therefore, the refrigerant gas tends to accumulate at the one end, the structure of the embodiment works effectively to suppress the occurrence of pulsation of discharge refrigerant gas resulting from the accumulation of the discharge refrigerant gas. Thus, the oil separation structure of the invention contributes to reduction of noise developed by the compressor in operation.

(3) The separation chamber forming hole 42 in which the separation chamber 50 is defined is formed in the joint surface 14*a* of the rear housing 14 and is closed by the joint surface 13*a* of the valve plate assembly 13. That is, in the present preferred embodiment, the separation chamber 50 is defined by utilizing the joined structure between the rear housing 14 and the valve plate assembly 13. In comparison with a structure wherein the separation chamber 50 is defined in the rear housing 14 without utilizing the joined structure between the rear housing 14 and the valve plate assembly 13, the present preferred embodiment dispense with a cover used exclusively for closing the separation chamber forming hole 42. In the present preferred embodiment, the valve plate assembly 13 doubles as a cover. Therefore, the number of parts of the compressor and man-hour for assembling the compressor are reduced.

(4) The first and second introduction passages 51, 52 are provided by the first and second grooves 51*a*, 52*a*, respectively, which are formed in the joint surface 14*a* of the rear housing 14 and closed by the joint surface 13*a* of the valve plate assembly 13. In comparison with a case wherein the first and second introduction passages 51, 52 are formed by drilling, the first and second introduction passages 51, 52 have higher degree of freedom in shaping of the passage (shape of extension and transverse section). This manner of shaping is advantageous in forming a plurality of passages such as the first and second introduction passages 51, 52 in a limited space.

(5) The first and second introduction passages 51, 52 are so constructed that the cross sectional areas thereof gradually reduce from the side of the discharge chamber 24 toward the openings 51*b*, 52*b*, respectively. By so constructing the passages 51, 52, the directivity of the discharge refrigerant gas being introduced into the separation chamber 50 is enhanced, and the discharge refrigerant gas is introduced from the first and second introduction passages 51, 52 into the separation chamber 50 in such a manner that the turning of the discharge refrigerant gas in the separation chamber 50 is not hampered. Such arrangement of convergent cross section of the first and second introduction passages 51, 52 toward the openings 51*b*, 52*b* is easily accompanied by forming the first and second introduction passages 51, 52 at the joints between the rear housing 14 and the valve plate assembly 13.

(6) A somewhat deep hole is made in the rear housing 14 as the separation chamber forming hole 42 which forms the separation chamber 50, and part of he holes 42 is utilized for receiving the check valve 45. As compared with a case in which an additional hole for receiving therein the check valve 45 is made in the rear housing 14 apart from the separation chamber forming hole 42, the preferred embodiment of the invention is advantageous in that the oil separation structure and the check valve structure are simplified.

(7) The seat 46 of the check valve 45 serves to form a partition member which divides the separation chamber forming hole 42 into the separation chamber 50 and the check valve accommodation chamber 42*a*, and the valve port 46*a* is formed through the middle of the seat 46 thereby to establish fluid communication between the check valve accommodation chamber 42*a* and the separation chamber 50. Therefore, with the check valve 45 inserted in place in the separation chamber forming hole 42, the separation chamber 50 and the check valve accommodation chamber 42*a* are defined in the separation chamber forming hole 42 and, at the same time, communication between the separation chamber 50 and the check valve 45 (or the check valve accommodation chamber 42*a*) is achieved. Thus, the seat 46 of the check valve 45 is utilized as a partition member and the valve port 46*a* of the seat 46 as a passage which makes the check valve 45 to communicate with the separation chamber 50, thereby, simplifying the oil separation structure and the structure of the check valve.

(8) The first and second introduction passages 51, 52, whose cross section forms a quadrangular shape, have the wall surfaces 51*c*, 52*c*, which are tangent to the circle of the cylindrical inner surface 41. If the introduction passage has a circular cross section formed, for example, by drilling (such cross section for the first introduction passage 51 being shown by two-dot chain line in FIG. 3), the inner circular wall of the passage is tangent to the circle of the cylindrical inner surface 41 of the separation chamber 50 by way of a straight line indicated by dotted line "L" in FIG. 3. Thus, the oil separation structure of the present preferred embodiment having introduction passages 51, 52 formed with the tangent wall surfaces 51*c*, 52*c* permits a large amount of discharge refrigerant gas to be introduced easily into the separation chamber 50 along the cylindrical inner surface 41 and, therefore, the turning motion of the discharge refrigerant gas in the separation chamber 50, hence oil separation, is improved.

(9) In the preferred embodiment, the opening 28*a* of the supply passage 28 is located in the region "A" lying between the seat 46 and the opening 52*b* of the second introduction passage 52 which is closer to the seat 46 than the opening 51*b* of the first introduction passage 51. The turning of the discharge refrigerant gas is weaker in the region "A" than in a region which corresponds to the openings 51*b*, 52*b* of the introduction passages 51, 52, and the oil which is separated from the discharge refrigerant gas tends to be accumulated in this region "A". Therefore, the oil thus separated from the discharge refrigerant gas in the separation chamber 50 is efficiently sent out of the separation chamber 50 through the opening 28*a* of the supply passage 28 arranged in the region "A".

The present invention is not limited to the above-mentioned preferred embodiment, but may be modified within the scope of the appended claims, as exemplified below.

In the above-mentioned preferred embodiment, two introduction passages, namely, the first and second introduction passages 51, 52 are formed in the rear housing 14. It is noted, however, that the number of such introduction passages is not limited to two. In alternative embodiments to the preferred embodiment, the number of introduction passages may be more than two.

In the above-mentioned embodiments, the first and second introduction passages 51, 52 are provided such that the first and second grooves 51*a*, 52*a* which are formed in the rear housing 14 are closed by the valve plate assembly 13. In alternative embodiments to the embodiments, the first and second introduction passages 51, 52 are provided by a first hole 51*e* and a second hole 52*e* which are formed through the rear housing 14 by drilling, as shown in FIG. 4.

Figure 4:
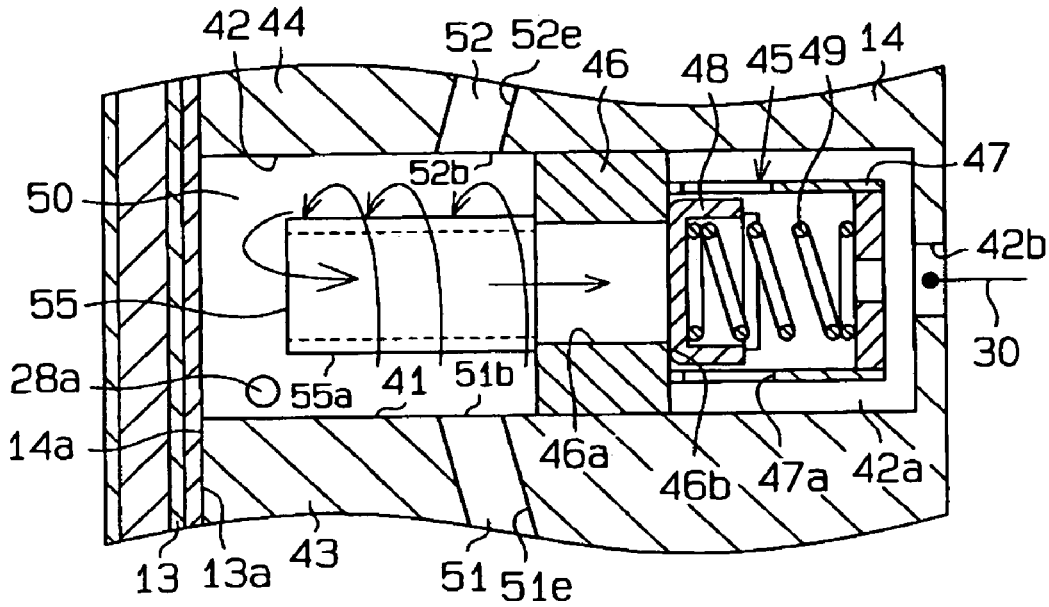
FIG. 4 is a partial cross sectional view illustrating an oil separation structure according to another preferred embodiment of the present invention.

In alternative embodiments to the embodiments, a cylindrical body 55 is arranged in the axial center of the separation chamber 50, as shown in FIG. 4. By providing such cylindrical body 55 in the separation chamber 50, the discharge refrigerant gas in the separation chamber 50 tends to flow in the circumferential direction between the cylindrical inner surface 41 of the separation chamber forming hole 42 and the outer peripheral surface 55*a* of the cylinder 55, and the turning flow of the refrigerant gas is stabilized. Consequently, the oil separation in the separation chamber 50 is effectively performed. The cylindrical body 55 is fixed to the seat 46 which is in turn fixed to the separation chamber forming hole 42. The opening 28*a* of the supply passage 28 is located in a region in the separation chamber 50 adjacent to the valve plate assembly 13, where the turning of the refrigerant gas is weak.

It is noted that the cylindrical body 55 need not be hollow as shown in FIG. 4, but it may be made solid. In this case, the solid cylindrical body is provided away from the seat 46 so that the valve port 46*a* is not closed, and fixed in the separation chamber forming hole 42 by using a circlip.

Figure 5:
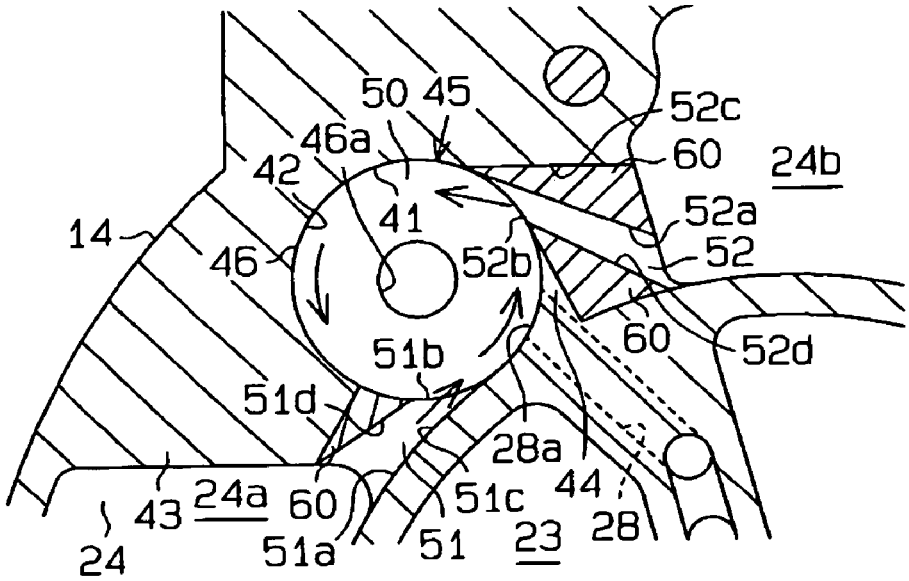
FIG. 5 is a partial cross sectional view illustrating an oil separation structure according to yet another preferred embodiment of the present invention.

In the above-mentioned embodiments, the first and second introduction passages 51, 52 are so constructed that the inner surfaces of the first and second grooves 51*a*, 52*a* formed in the rear housing 14 form the inner wall surfaces of the introduction passages 51, 52. Specifically, the inner wall surfaces of the introduction passages 51, 52 include the surfaces 51*c*, 51*d*, 52*c*, 52*d* and the surfaces corresponding to the bottom surfaces of the grooves 51*a*, 52*a*. In alternative embodiments to the embodiments, as shown in FIG. 5, the grooves 51*a*, 52*a* are formed with the cross sectional area that is larger than the desired cross sectional area of the first and second introduction passages 51, 52. A wall member 60 which is separate from the rear housing 14 and the valve plate assembly 13 is inserted in each of the first and second grooves 51*a*, 52*a* so that the wall member 60 forms a part of the inner wall surfaces of the first and second introduction passages 51, 52.

The use of such wall member 60 makes it possible to adjust the shape of the first and second introduction passages 51, 52 (shape of extension and transverse section) by modifying the shape of the wall member 60 without changing the shape of the rear housing 14, or the shape of the grooves 51*a*, 52*a*. Preparing a plurality of wall members 60 having different shapes, an appropriate wall member 60 having the suitable shape is selected for use in an oil separation structure having specific oil separation characteristics (or the turning characteristics of refrigerant gas in the separation chamber 50). In addition, the rear housing 14 of the same shape can be used in compressors having the different oil separation characteristics and, therefore, the manufacturing cost of the compressor is reduced.

In the above-mentioned embodiments, the suction chamber 23 is formed in the middle of the rear housing 14 while the discharge chamber 24 is formed so as to surround the suction chamber 23. In alternative embodiments to the embodiments, the suction chamber 23 is formed surrounding the discharge chamber 24 which is defined in the middle of the rear housing 14.

In the above-mentioned embodiments, the first and second grooves 51*a*, 52*a* which form the first and second introduction passages 51, 52 are formed only in the joint surface 14*a* of the rear housing 14. In alternative embodiments to the embodiments, at least two grooves are formed in the joint surface 13*a* of the valve plate assembly 13, as well as the first and second grooves 51*a*, 52*a* formed in the joint surface 14*a* of the rear housing 14, so that the first and second introduction passages 51, 52 are formed by combining the first and second grooves 51*a*, 52*a* formed in the rear housing 14 on one hand and the grooves formed in the valve plate assembly 13 on the other. In yet alternative embodiments to the embodiments, the grooves which form the first and second introduction passages 51, 52 are formed only in the joint surface 13*a* of the valve plate assembly 13.

In the above-mentioned embodiments, the check valve 45 is accommodated in the separation chamber forming hole 42 in which the separation chamber 50 is defined. In alternative embodiments to the embodiments, however, a hole separate from the separation chamber forming hole 42 is formed in the rear housing 14 and accommodates the check valve 45 therein.

In the above-mentioned embodiments, the piston type swash plate compressor is of a variable displacement type. In alternative embodiments to the embodiments, the compressor is of a fixed displacement type. It is noted, however, that the compressor is not limited to the swash plate piston type, but the compressor includes a scroll type and a vane type.

Therefore, the present examples and embodiments are to be considered as illustrative and not restrictive and the invention is not to be limited to the details given herein but may be modified within the scope of the appended claims.

What is claimed is:

1. A structure for separating oil from a refrigerant gas containing the oil, the refrigerant gas being discharged from a refrigerant compressor which forms a part of refrigerating cycle to an external refrigerant circuit, the oil separation structure comprising:

a separation chamber in which the oil is separated from the discharge refrigerant gas having a cylindrical inner surface, and a plurality of introduction passages through which the discharge refrigerant gas is introduced into the separation chamber, the oil being separated by centrifugal action from the discharge refrigerant gas by turning the discharge refrigerant gas introduced into the separation chamber along the cylindrical inner surface, wherein the compressor includes a rear housing that serves as a cylinder head having a first joint surface and a valve plate assembly having a second joint surface, the rear housing and the valve plate assembly defining a discharge chamber and the separation chamber when the first joint surface and the second joint surface are joined together, each introduction passage interconnecting the discharge chamber with the separation chamber and being formed at the joint between the rear housing and the valve plate assembly, at least one of the first joint surface and the second joint surface having a groove formed therein, each introduction passage being so formed that the groove is closed when the first joint surface and the second joint surface are joined together.

2. The oil separation structure according to claim 1, wherein the refrigerant compressor is of a piston type the rear housing having a separation chamber forming hole in the first joint surface, the separation chamber forming hole being closed by the second joint surface, the separation chamber being defined in the separation chamber forming hole.

3. The oil separation structure according to claim 2, wherein the refrigerant compressor has a check valve in a refrigerant passage between the discharge chamber and the external refrigerant circuit for preventing the refrigerant gas from flowing back from the external refrigerant circuit toward the discharge chamber, the compressor also having a partition member which is inserted in the separation chamber forming hole thereby dividing the separation chamber forming hole into the separation chamber on the valve plate assembly side and a check valve accommodation chamber for accommodating the check valve therein.

4. The oil separation structure according to claim 3, wherein the check valve has a valve body for opening and closing a refrigerant channel between the separation chamber and the external refrigerant circuit, and a seat for movably supporting the valve body, the seat being served as the partition member and having a valve port formed therethrough at the center of the seat between the check valve accommodation chamber and the separation chamber, the valve port being opened and closed by the valve body, the discharge refrigerant gas from which the oil has been separated in the separation chamber being introduced into the check valve through the valve port.

5. The oil separation structure according to claim 1, wherein the introduction passages are so constructed that the cross sectional areas thereof gradually reduce from the discharge chamber to the separation chamber.

6. The oil separation structure according to claim 1, wherein the refrigerant compressor has a wall member which is separate from the rear housing and the valve plate assembly, the wall member being inserted in the groove and forming a part of inner wall surface of the introduction passage.

7. The oil separation structure according to claim 2, wherein the refrigerant compressor has a check valve in a refrigerant passage between the discharge chamber and the external refrigerant circuit for preventing the refrigerant gas from flowing back from the external refrigerant circuit toward the discharge chamber, the compressor also having a partition member which is inserted in the separation chamber forming hole thereby dividing the separation chamber forming hole into the separation chamber on the valve plate assembly side and a check valve accommodation chamber for accommodating the check valve therein, the separation chamber and a crank chamber, whose pressure is lower than that of the separation chamber, being in communication via an oil returning passage, an opening of the oil returning passage in the separation chamber being located in the cylindrical inner surface lying between an opening of the introduction passage which is formed closer to the partition member than that of the other introduction passage and the partition member in the axial direction of the separation chamber forming hole.

8. The oil separation structure according to claim 1, wherein the cross section of each introduction passage forms a quadrangular shape.

9. The oil separation structure according to claim 1, wherein the separation chamber and a crank chamber, whose pressure is lower than that of the separation chamber, are in communication via an oil returning passage.

10. The oil separation structure according to claim 1, wherein the refrigerant compressor has the discharge chamber whose cross section forms an annular shape but part of which is spaced in such a manner that the discharge chamber has a first end and a second end, the introduction passages having at least a first introduction passage which interconnects the first end of the discharge chamber with the separation chamber, and a second introduction passage which interconnects the second end of the discharge chamber with the separation chamber.

* * * * *

UNITED STATES PATENT AND TRADEMARK OFFICE

CERTIFICATE OF CORRECTION

PATENT NO. : 7,204,098 B2
APPLICATION NO. : 10/834740
DATED : April 17, 2007
INVENTOR(S) : Yoshinari Yamada et al.

It is certified that error appears in the above-identified patent and that said Letters Patent is hereby corrected as shown below:

IN THE SPECIFICATION

Column 1, lines 24-25, please delete "oil to heat exchanger" and insert therefore -- oil to a heat exchanger --;

Column 1, line 32, please delete "cross sectional" and insert therefore -- cross-sectional --;

Column 2, lines 13, 17 and 20, please delete "cross sectional" and insert therefore -- cross-sectional --;

Column 3, line 3, please delete "16. (only" and insert therefore -- 16 (only --;

Column 4, lines 13-14, please delete "compressor will be described" and insert therefore -- compressor --;

Column 4, line 21, please delete "position In" and insert therefore -- position in --;

Column 5, lines 58 and 62-63, please delete "cross sectional" and insert therefore -- cross-sectional --;

Column 5, line 65, please delete "cross sections" and insert therefore -- cross-sections --;

Column 6, lines 12 and 27, please delete "cross sectional" and insert therefore -- cross-sectional --;

Column 6, line 59, please delete "lower than of" and insert therefore -- lower than that of --;

Column 7, lines 22 and 26, please delete "cross sectional" and insert therefore -- cross-sectional --;

Column 7, line 58, please delete "embodiment dispense with" and insert therefore -- embodiment dispenses with --;

Column 7, line 62, please delete "man-hour for assembling" and insert therefore -- man-hours required for assembling --;

Column 8, line 10, please delete "cross sectional" and insert therefore -- cross-sectional --;

UNITED STATES PATENT AND TRADEMARK OFFICE

CERTIFICATE OF CORRECTION

PATENT NO. : 7,204,098 B2
APPLICATION NO. : 10/834740
DATED : April 17, 2007
INVENTOR(S) : Yoshinari Yamada et al.

It is certified that error appears in the above-identified patent and that said Letters Patent is hereby corrected as shown below:

Column 8, line 20, please delete "cross section" and insert therefore -- cross-section --;

Column 8, line 22, please delete "52b is easily accompanied" and insert therefore -- 52b is easily accomplished --;

Column 8, line 27, please delete "part of he holes 42" and insert therefore -- part of the hole 42 --;

Column 8, line 52, please delete "to communicate with" and insert therefore -- communicate with --;

Column 8, lines 56, 59 and 60, please delete "cross section" and insert therefore -- cross-section --; and Column 10, line 1, please delete "cross sectional" and insert therefore -- cross-sectional --.

Signed and Sealed this

Twenty-second Day of September, 2009

David J. Kappos

David J. Kappos
*Director of the United States Patent and Trademark Office*